US005361957A

United States Patent [19]

Weintraub

[11] Patent Number: 5,361,957

[45] Date of Patent: Nov. 8, 1994

[54] SHOULDER STRAP CUSHION

[76] Inventor: Marvin H. Weintraub, 5743 Kingsfield Dr., West Bloomfield, Mich. 48322

[21] Appl. No.: 112,674

[22] Filed: Aug. 26, 1993

[51] Int. Cl.[5] ..... A45F 3/12

[52] U.S. Cl. ..... 224/264; 224/202

[58] Field of Search ..... 224/264; 2/2, 267, 268; 150/107, 110; 224/202

[56] References Cited

U.S. PATENT DOCUMENTS

| | | | |
|---|---|---|---|
| 1,444,157 | 2/1923 | Lee | 224/264 |
| 3,883,053 | 5/1975 | Pritchard et al. | 224/264 |
| 4,384,602 | 5/1983 | Ores | 224/264 X |
| 4,795,399 | 1/1989 | Davis | 2/267 X |
| 4,879,768 | 11/1989 | McClees et al. | 224/264 X |

FOREIGN PATENT DOCUMENTS

| | | | |
|---|---|---|---|
| 2406402 | 6/1979 | France | 224/264 |
| 63244 | 2/1913 | Switzerland | 224/264 |
| 113758 | 9/1916 | United Kingdom | 224/264 |

*Primary Examiner*—Glenn T. Barrett

*Attorney, Agent, or Firm*—Weintraub, DuRoss & Brady

[57] ABSTRACT

A shoulder strap for a carrying device such as a suitcase or the like has a cushion incorporated therewith. The cushion is an inflatable member which is either integrally formed with the strap or removably secured thereto. The cushion minimizes the strain placed upon the shoulder of a user by distributing the load through the cushion.

4 Claims, 1 Drawing Sheet

FIG 1
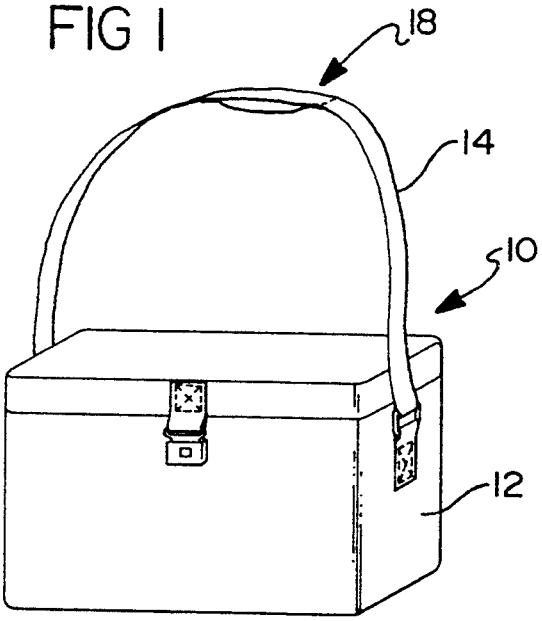
FIG 2
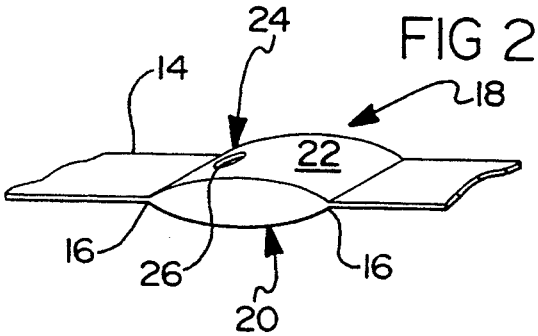
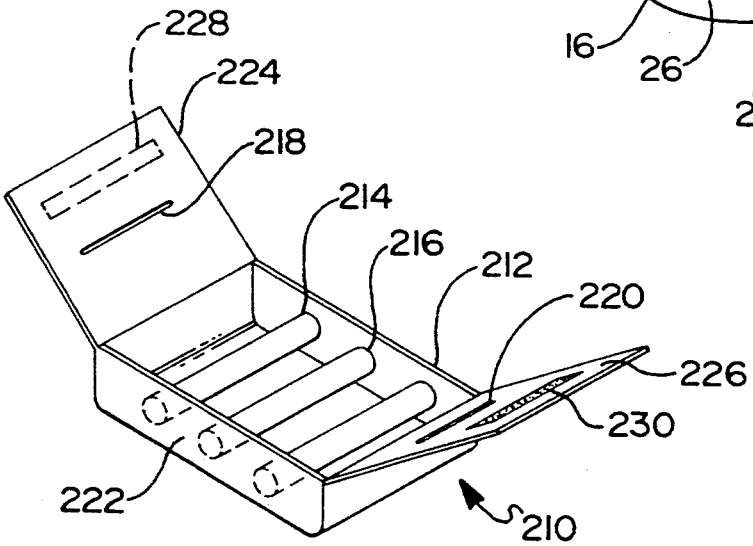
FIG 4
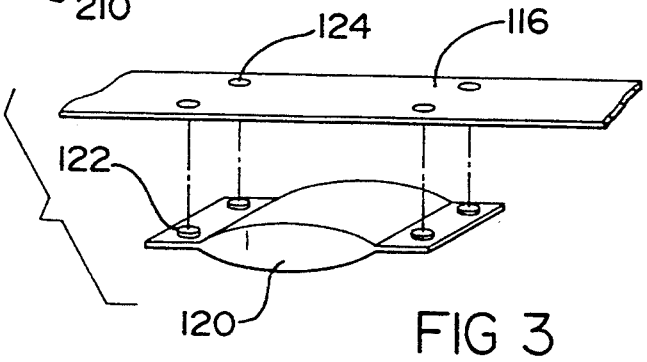
FIG 3

SHOULDER STRAP CUSHION

The present invention concerns shoulder straps for luggage, purses, other carrying devices, safety seat belts and the like. More particularly, the present invention concerns cushioned shoulder straps for such carrying devices. Prior Art Typically, carrying devices such as suitcases, valises, purses and the like, have shoulder straps to facilitate the transport of such articles. By distributing the weight of the contents of the carrying device to the shoulder, ease of transportability is enhanced. However, depending on the weight of the contents of the carrying device, after bearing the shoulder strap for a considerable period of time, strain and discomfort often set in. Alleviating this strain, stress and discomfort, ordinarily, requires shifting the device from one shoulder to another and back and forth. This becomes cumbersome and awkward. Oftentimes, after many back and forth shifts, there is no relaxing of the strain. Heretofore, to applicant's knowledge, there has been no way to cushion or alleviate the strain placed upon the shoulder when towing such carrying devices. It is to this to which the present invention is directed.

SUMMARY OF THE INVENTION

In accordance with the present invention there is provided a shoulder strap for a carrying device having means for cushioning associated therewith. In a preferred embodiment hereof the means for cushioning comprises an inflatable pocket which rests upon the shoulder of the user. The inflatable or inflated pocket has means for introducing a fluid, such as air, thereinto. The inflated pocket is a sealed fluid container.

The means for cushioning can be incorporated directly into a shoulder strap or can be a removable device, which is removably securable to the strap.

The present device can be used for transporting luggage, brief cases and similar such devices. Likewise, the device can be incorporated into a shoulder harness, etc.

For a more complete understanding of the present invention reference is made to the following detailed description and accompanying drawing. In the drawing, like reference characters referred to like parts throughout the several views in which:

BRIEF DESCRIPTION OF THE DRAWING

FIG. 1 is a perspective view of a shoulder strap in accordance herewith shown as associated with a suitcase;

FIG. 2 is a broken, front view of the means for cushioning contemplated herein;

FIG. 3 is a broken, exploded perspective of an alternate embodiment, and

FIG. 4 is a perspective view of a still further embodiment of the means for cushioning contemplated herein.

DESCRIPTION OF THE PREFERRED EMBODIMENT

Now, and with reference to the drawing, there is depicted therein a carrying device, generally, denoted at 10, and illustrated herein as a suitcase 12. Of course, it is to be understood that within the scope of the present invention the carrying device 10 can be other than a suitcase, such as a valise, box, brief case, purse, or any other carrying device.

Associated with the carrying device is a shoulder strap 14. The shoulder strap 14 is adapted to be placed on the shoulder of the user (not shown) to transmit the load thereto. The shoulder strap 14, per se, may be integral with or removably detachable from the carrying device, as is known to the skilled artisan.

In accordance herewith, means for cushioning, generally, denoted at 18, is associated with the shoulder strap 14. In the first embodiment hereof, and as shown in FIGS. 1 and 2, the means 18 is integrally formed with the strap, such as by sewing, sonic welding, such as at 16, etc. It is to be understood that the mode by which the means for cushioning 18 is rendered integral is not critical hereto. It is only essential to this embodiment that the means 18 be integral with the strap. The means for cushioning generally comprises a pocket 20 as noted.

As shown, the pocket 20 has longitudinal ends which are secured to the strap 14 by any suitable means, such as by sonic welding, sewing, gluing or the like.

The pocket 20 comprises an inflatable or expansible member 22 having means for inflating 24 incorporated therewith. The means for inflating comprises a one-way valve 26 of well-known construction. These valves are typically deployed for inflating childrens toys, floatable air rafts, and the like and comprise elongated stems through which air is introduced into the interior of the pocket. Typically, such valves comprise a duct having means such as ports. in fluid communication with the interior. An extensible-retractable stem is slidably disposed in the duct and in the retracted positions covers or seals the port. Traditionally, upon extension of the stem, communication to the interior of the pocket is afforded permitting the pocket to be inflated. A cap or the like closes off the open end of the stem to minimize leakage of air therepast. Again, these valves are well known to the skilled artisan. It is to be understood that other one-way valves, which can be used to inflate the pocket may be used herein. Preferably, though, the well-known stem-type valve is employed since it enables the pocket to be inflated with the user's breath, as well as other sources, such as a pneumatic pump, air compressor or the like.

In accordance herewith the valve is incorporated into the means 18 at such a position such that it does not hit the shoulder.

In a second embodiment hereof, and as shown in FIG. 3, the means for cushioning 118 is detachably mounted to the strap 116. Herein, any suitable means for detachable mounting, such as complementary snaps 120, 122, a VELCRO-Type hook and loop interlock or the like is used. According to this embodiment complementary male and female snaps are used.

In such an embodiment the pocket 120 has elongated mounting members, such as excess material extending from the pocket, as shown. The snaps are secured to the members by any suitable means such as sewing, etc. Mating snaps are, then, provided on the strap to provide snapping attachment therebetween. Alternatively, a first VELCRO strip can be secured to a portion of the pocket and a complimentary strip provided on the strap in a well-known manner. In this manner, the means for cushioning can be deployed, when desired, by merely securing it to the strap and inflating same or inflating it first and then attaching it to the strap.

Alternatively, and although not shown, the strap 14 or 116 may have a VELCRO strap provided along the extent thereof. The complementary straps on the mounting member enables the user to positionably select where the device is to be positioned on the strap, and can be positionably mounted.

In either event, though, the inflatable means for cushioning is placed on the shoulder at the area where the load is admitted thereby transmitting the load or forced throughout the pocket and, thus, minimizing the strain which is placed directly upon the shoulder.

In a further embodiment hereof, and as shown in FIG. 4, the device 210 comprises a sheath or pocket 212 having a plurality of inflatable tubular elements 214, 216, etc. disposed therein. The elements 214, 216, etc. are fixedly mounted in the sheath 212 by any suitable means, such as by gluing, sonic welding or the like. Preferably, the tubular elements are spaced apart, usually, equidistantly, and are filled with a suitable fluid, such as air, water, or similar fluid. The number of elements is not critical hereto, so long as the desired cushioning effect is achieved. The tubular elements may be permanently sealed or inflatable, in the same manner as heretofore described. Likewise, the sheath 212 may be either permanently or removably affixed to a shoulder strap or the like (not shown) as heretofore described. Likewise, the sheath may be laced onto the strap through slits 218, 220 in a known manner.

As shown in FIG. 4, the pocket 212 has a tray portion 222 in which the tubular elements are seated. A pair of overlapping cover flaps 224, 226 cooperate to enclose the tray. A Velcro strap 228, 230, respectively, is disposed on each flap, as shown, the close off the tray. A slit formed in each flap enables the strap to be laced or belted therethrough to slidably, adjustably, mount the device 210 to the strap.

In practicing the present invention the means 18 or 118 may comprise any suitable inflatable material, such as a flexible polyethylene, polypropyline, inflatable latex, or the like.

Having, thus, described the invention, what is claimed is:

1. In combination with a shoulder strap for a carrying device, means for cushioning the weight borne by a user, comprising:

(a) a pocket, having an open interior;

(b) a pair of spaced apart flaps secured to the pocket, the flaps being overlappable to enclose the pocket, each flap having a slit formed therein to enable the strap to be laced therethrough;

(c) means for securing the flaps to each other when in the overlapped position;

(d) a plurality of cushioning elements disposed in the interior of the pocket; and (e) a cushioning fluid disposed in each element.

2. The combination of claim 1 wherein:

the cushioning elements are inflatable hollow cushioning elements having an interior, the combination further comprising means for inflating the elements.

3. The combination of claim 2 wherein:

each element is sealed and the fluid is permanently stored within each element.

4. The combination of claim 2, wherein the means for inflating comprises a one-way valve for emitting the fluid into the interior of the element, the fluid being air.

* * * * *